US005596180A

United States Patent [19]

Hofmann et al.

[11] Patent Number: 5,596,180

[45] Date of Patent: Jan. 21, 1997

[54] IGNITION SWITCH WITH ELECTRICALLY CONDUCTIVE LEAF SPRING MEMBERS AND ROTARY CAM OPERATOR

[75] Inventors: Georg Hofmann; Jürgen Suchanek, both of Auburn Hills; Larry W. Burr, Saginaw, all of Mich.

[73] Assignees: ITT Automotive, Inc., Auburn Hills; General Motors Corp., Detroit, both of Mich.

[21] Appl. No.: 415,656

[22] Filed: Apr. 3, 1995

[51] Int. Cl.[6] ..... H01H 11/00; H01H 19/60; H01H 21/84

[52] U.S. Cl. ..... 200/6 B; 29/622; 200/6 BB; 200/11 C; 200/283

[58] Field of Search ..... 200/4, 6 R–6 C, 200/11 R–11 TN, 283; 29/622

[56] References Cited

U.S. PATENT DOCUMENTS

| | | | |
|---|---|---|---|
| 3,097,269 | 7/1963 | Campbell | 200/16 C |
| 3,271,531 | 9/1966 | Winogrocki et al. | 200/11 C |
| 3,293,399 | 12/1966 | Heinrich | 200/11 TW |
| 3,319,016 | 5/1967 | Hoy et al. | 200/16 C |
| 3,339,032 | 8/1967 | Hults | 200/16 C |
| 3,500,389 | 3/1970 | Robinson | 200/11 TW X |
| 3,719,788 | 3/1973 | Holland et al. | 200/6 BB |
| 3,903,383 | 9/1975 | Marker | 200/11 TW |
| 3,971,904 | 7/1976 | Ward | 200/6 BB |
| 4,042,795 | 8/1977 | Sykora | 200/16 D |
| 4,204,098 | 5/1980 | Strande | 200/6 R |
| 4,563,551 | 1/1986 | Black, III et al. | 200/16 C |
| 4,616,112 | 10/1986 | Galloway et al. | 200/5 R |
| 4,751,352 | 6/1988 | Botz et al. | 200/6 BB |
| 4,766,272 | 8/1988 | Guzzon | 200/302.2 |
| 4,868,352 | 9/1989 | Botz et al. | 200/4 |
| 5,182,422 | 1/1993 | Botz et al. | 200/61.54 |
| 5,182,423 | 1/1993 | Botz et al. | 200/61.54 |
| 5,196,662 | 3/1993 | Hofmann | 200/61.54 |
| 5,237,133 | 8/1993 | Frank | 200/11 C |
| 5,374,777 | 12/1994 | Hofmann | 174/50 |

FOREIGN PATENT DOCUMENTS

| | | | |
|---|---|---|---|
| 87944 | 10/1959 | Denmark . | |
| 1904616 | 8/1970 | Germany . | |
| 2533802 | 7/1975 | Germany . | |
| 3219579 | 12/1982 | Germany | H01H 25/00 |
| 3237055 | 4/1983 | Germany | H01H 15/02 |
| 4233520 | 6/1994 | Germany | H01H 19/62 |
| 610395 | 10/1960 | Italy . | |

OTHER PUBLICATIONS

Schalter Dreh ("Rotary Switch"), 0724, G–501. 420–D, Dated Sep. 15, 1988.

Stueck Schalt Switch Block 4270, Dated Sep. 15, 1988.

Schalter Schalt Switch Block 0724, A–501.20–E, Dated Sep. 15, 1988.

*Primary Examiner*—J. R. Scott

*Attorney, Agent, or Firm*—Thomas N. Twomey; J. Gordon Lewis

[57] ABSTRACT

An electrical switch selectively controls an ignition circuit and accessory circuits of a motor vehicle. The electrical switch includes a rotatable member with radially extending side walls having cam surfaces formed thereon for operably actuating electrically conductive leaf spring members to individually open and close electrical circuits in response to positioning the rotatable member in predefined angular positions. The electrical switch can include both high current and low current leaf spring members in a single switch assembly capable of being assembled from one side.

20 Claims, 5 Drawing Sheets

IGNITION SWITCH WITH ELECTRICALLY CONDUCTIVE LEAF SPRING MEMBERS AND ROTARY CAM OPERATOR

FIELD OF THE INVENTION

The present invention relates to an electric ignition switch for motor vehicles located in a housing for rotatable movement between several switching positions.

BACKGROUND OF THE INVENTION

An electrical rotary switch of a type suitable for use in a road vehicle as a starter or ignition switch, was previously disclosed in published German Patent Application No. 42 33 520. The electrical rotary switch disclosed in the German published patent has a central spindle with cam elements that operate against movable contact carriers. Each carrier is retained by a coil spring and pivots about a support plate. The carrier has contacts at the end and has projections that the cam engages. The center spindle has slots engaged by spring loaded indent elements to define the positions. This ignition switch is capable of controlling functions such as radio, charge monitoring lights, oil pressure, etc. The ignition switch disclosed has a simple design suitable for automated production.

SUMMARY OF THE INVENTION

It is desirable in the present invention to reduce the overall dimensions of the ignition switch according to the present invention and to reduce the cost of production. It is further desirable in the present invention to simplify the overall design of the ignition switch, while reducing the number of elements to be assembled with respect to one another and by incorporating previously external actuating members internally within the ignition switch housing. In addition, it is desirable in the present invention to replace the spring biased bridges previously used with electrically conductive leaf springs. It is further desirable in the present invention to provide spring biased locking mechanisms to hold the switch housing in place when installed in the ignition switch casting. It is desirable in the present invention to provide electrically conductive insert molded parts to further simplify assembly and reduce costs. It has also been found desirable to use ultrasonic welding of wires to the stationary side or end of the electrically conductive leaf spring members to protect the leaf spring members from detrimental changes due to high temperature produced during soldering operations which may result in weak leaf springs. The weaker leaf springs are a consequence of excessive heating and detrimentally impact the spring back tendency of the electrically conductive leaf spring members. It has further been found desirable to make the electrically conductive leaf spring members of beryllium copper (BeCu) material.

The present invention provides an ignition switch approximately half the size of previously known ignition switches and builds the actuator gear into the switch housing. By reducing the number of elements, the present invention eliminates tolerance build-ups that can lead to unsatisfactory operation of ignition switches. The present invention desirably replaces three previously used parts, namely, the lobe follower, hinge point and compression spring, with a single electrically conductive leaf spring member for each switched circuit. Furthermore, it is desirable in the present invention to provide an ignition switch that can be assembled from one side starting from the bottom cover with subsequent parts installed layer by layer until the top cover is assembled.

The present invention discloses an electrical switch including housing means having a first wall for supporting a first electrical contact and a first aperture extending through the first wall. Rotatable means is connected to the housing means for rotation about a pivot axis extending generally normal to the first wall. The rotatable means includes a radially extending wall opposing the first wall of the housing. The radially extending wall has at least one arcuate, concentric cam surface sector opposing the aperture in the first wall. Plunger means is engageable through the aperture in the first wall for slidably engaging the cam surface with a first end and for moving a second end corresponding to a contour of the cam surface as the cam surface moves with respect to the first end when the rotatable means is rotated. Electrically conductive leaf spring means biases the plunger means toward the cam surface and selectively opens and closes an electrical circuit by allowing selective electrical engagement of the leaf spring means with the first contact in response to movement of the rotatable means. In the preferred configuration, the multi-function electrical ignition switch according to the present invention provides for movement between at least four positions including a stop position, a start position, a run position and an accessory position. Preferably, the ignition switch according to the present invention provides for switching both low current and high current connections selectively based on the position of the ignition switch.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
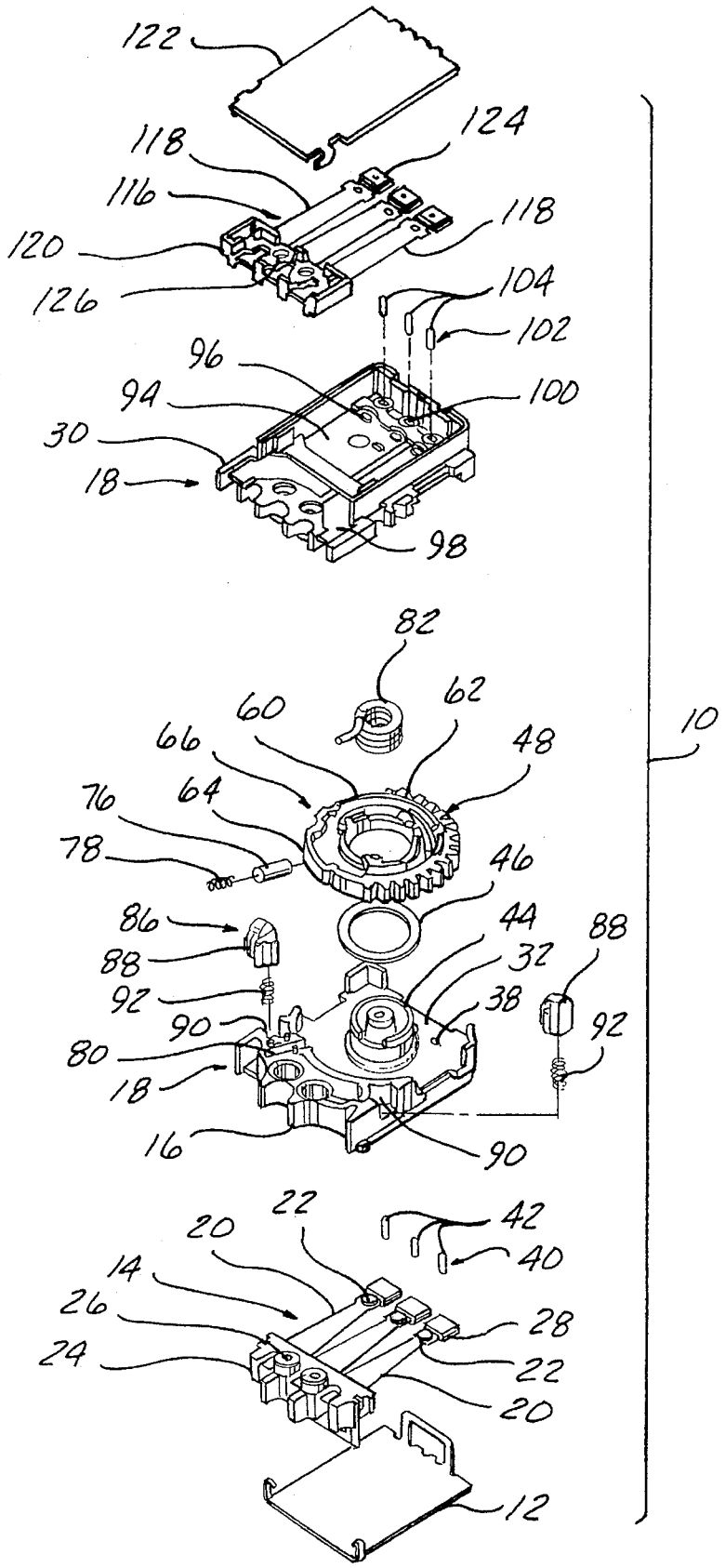
FIG. 1 is an exploded view of an ignition switch according to the present invention.

The present invention relates to an electrical rotary switch, generally designated as 10, particularly for use as an ignition switch in vehicles for controlling the starter, ignition and accessory functions. Referring now to FIGS. 1 through 8, the electrical rotary ignition switch 10 according to the present invention includes a first cover 12, or lower cover as illustrated in FIG. 1, to substantially enclose a first electrically conductive leaf spring means 14 with respect to a first part 16 of housing means 18. Preferably, the leaf spring means 14 is constructed of electrically conductive, resiliently flexible material. A metallic material such as beryllium copper (BeCu) has been found suitable for switching 35 amps of continuous power up to peaks of approximately 50 amps, as well as low amperage applications down to the milli-amp range. The first leaf spring means 14 can include at least one electrically conductive leaf spring member 20, and preferably a plurality of electrically conductive leaf spring members 20 independently operable and flexible with respect to one another such as the three leaf spring members 20 illustrated as part of the first leaf spring means 14 in FIG. 1. Each leaf spring member 20 includes an electrical contact 22 adjacent one end of the elongated leaf spring member 20. The opposite end of the elongated leaf spring member 20 is fixedly secured in place, so that the cantilevered electrical contact 22 on each leaf spring member 20 can be flexed outwardly toward the first cover 12 while simultaneously resiliently biased by the resiliency of the leaf spring member 20 toward its original position. Preferably, the first leaf spring means 14 is formed by injection molding plastic portions with respect to the electrically conductive leaf spring member 20. A common support 24 is preferably molded at the one anchored end of each leaf spring member 20 for holding the one end of each leaf spring member 20 fixedly secured in a relative position with respect to one another and including apertures 26 for attachment to the housing means 18. In addition, each leaf spring member 20 has at its opposite free cantilevered end an injection molded plastic pad 28 for operably receiving the driving force causing the leaf spring member 20 to flex outwardly from its normal position, generally in a planar configuration outwardly to a flexed position. As illustrated, each electrical contact 22 is in a closed position when in the normal unflexed position relative to the housing means 18 and is in an open position when flexed outwardly toward the first cover 12 away from the housing means 18. Preferably the first electrically conductive leaf spring means 14 as illustrated in FIG. 1 is a low current leaf spring means 14 capable of controlling the energization and deenergization of accessories and the like for the vehicle requiring current in the milli-amp range. The lower current leaf spring members 20 can be differentiated with respect to high current leaf spring members 118 by the reduced cross-section required for carrying the lower current.

Figure 5:
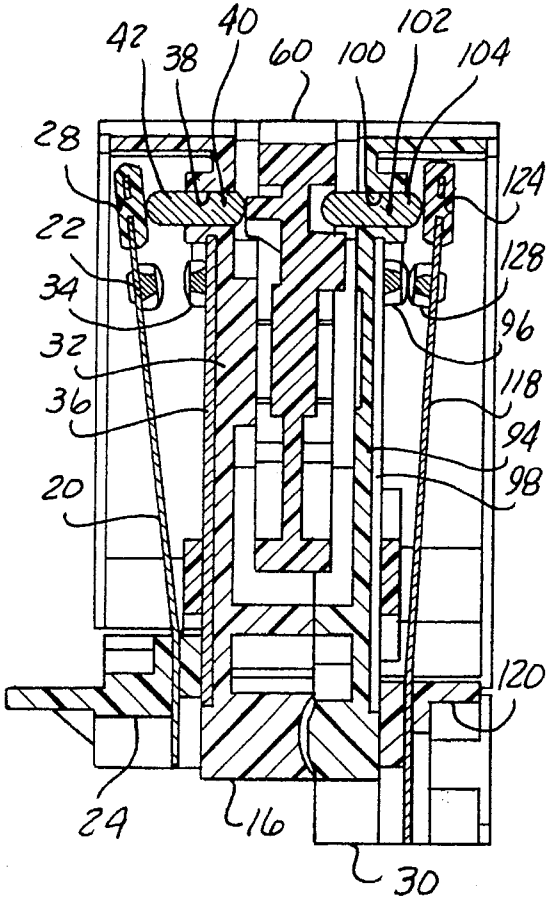
FIG. 5 is a cross-sectional view taken as shown in FIG. 2.
Figure 4:
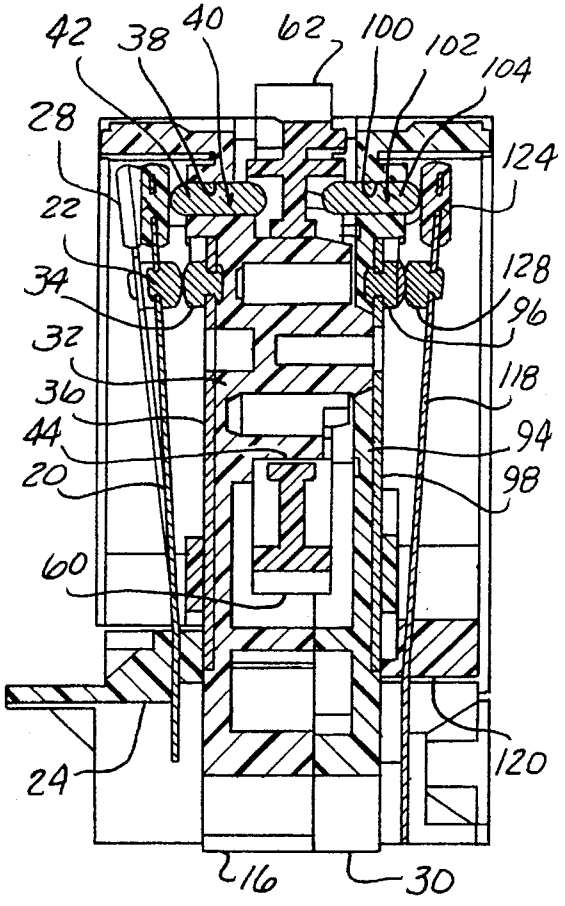
FIG. 4 is a cross-sectional view taken as shown in FIG. 2.
Figure 3:
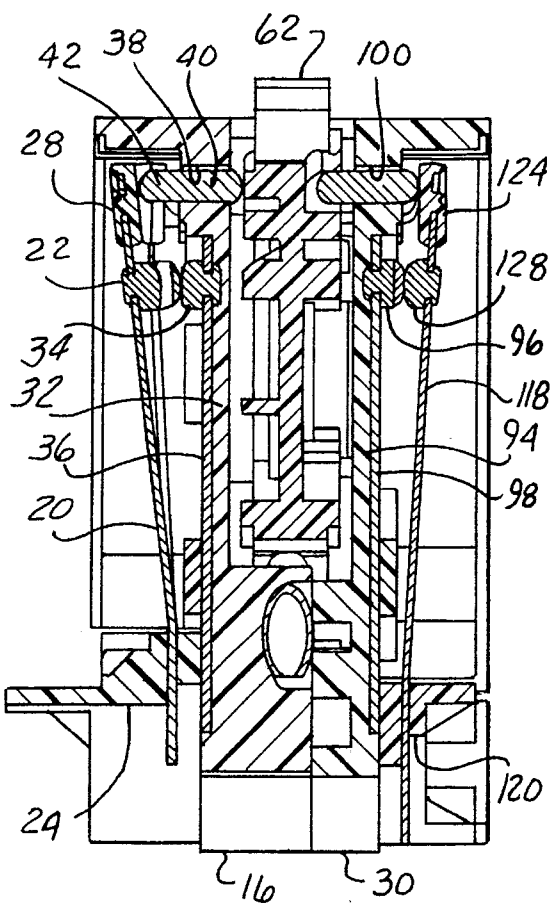
FIG. 3 is a cross-sectional view taken as shown in FIG. 2.

The housing means 18 includes a first part 16 and a second part 30 which are separable from one another. The first part 16 of the housing means 18 includes a first wall 32 for supporting at least one electrical contact 34 as best seen in FIGS. 3, 4 and 5. The number of electrical contacts 34 supported by the first wall 32 generally would correspond to the number of leaf spring members 20 existing for the particular application. By way of illustration, and not limitation, the present invention will be disclosed with reference to a plurality of electrical contacts 34, such as the three electrical contacts 34 illustrated in FIGS. 3, 4 and 5. At least one electrically conductive member or plate 36 is connected to each electrical contact 34. Preferably, the electrically conductive member 36 is injection molded as an insert into the first part 16 of the housing means 18. Adjacent each electrical contact 34, at least one aperture 38 extends through the first wall 32, such that the aperture 38 opens opposite from the pad 28 formed on the outer cantilevered end of the elongated leaf spring member 20 corresponding to the respective electrical contact 34 and corresponding aperture 38. Plunger means 40 is provided extending through each aperture 38 extending from the pad 28, or in contact with the pad 28, for actuating the flexing movement of the cantilevered end supporting the electrical contact 22 corresponding to the electrical contact 34 supported on the first wall of the first part 16 of the housing means 18.

Figure 8:
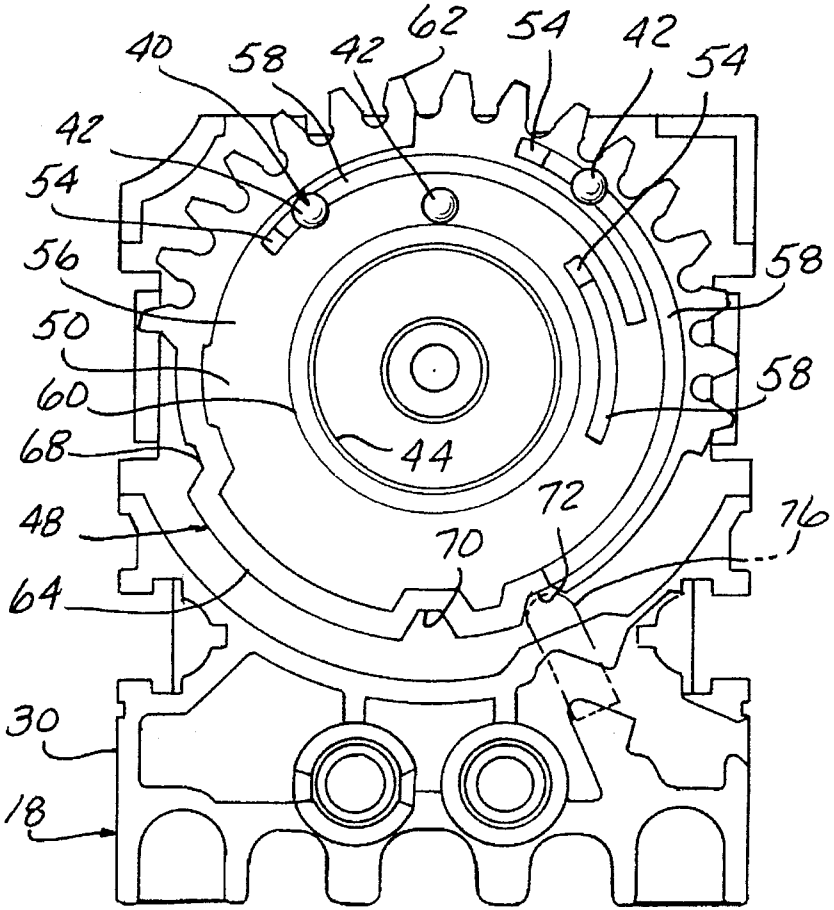
FIG. 8 is a plan view of the low current side of an ignition switch according to the present invention with the electrically conductive, low current leaf spring means and bottom half of the housing means removed for clarity.
Figure 7:
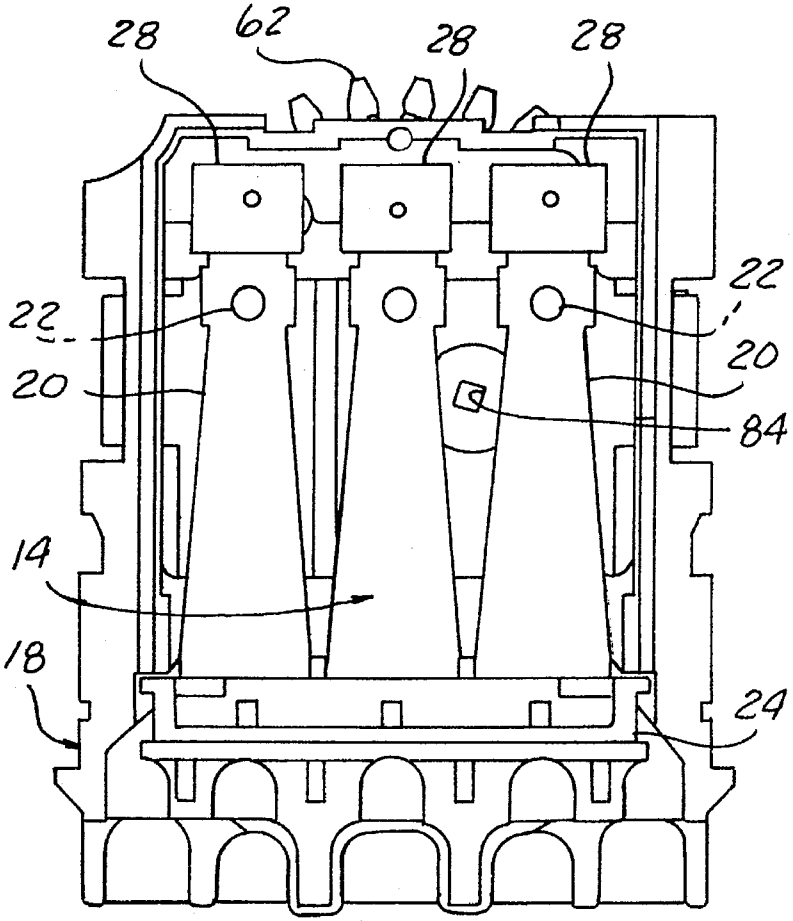
FIG. 7 is a plan view of a low current side of the ignition switch according to the present invention with the bottom cover removed as illustrated in the exploded view of FIG. 1 for clarity.
Figure 9:
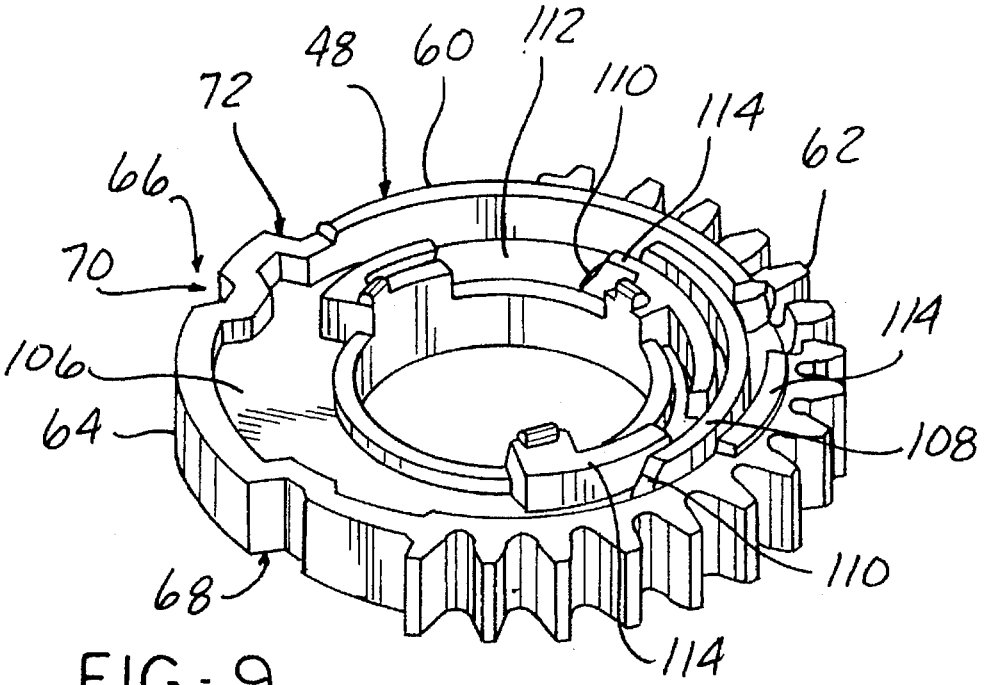
FIG. 9 is a perspective view of the rotatable means with an actuator gear sector around a portion of its periphery and with high current cam surfaces according to the present invention.
Figure 10:
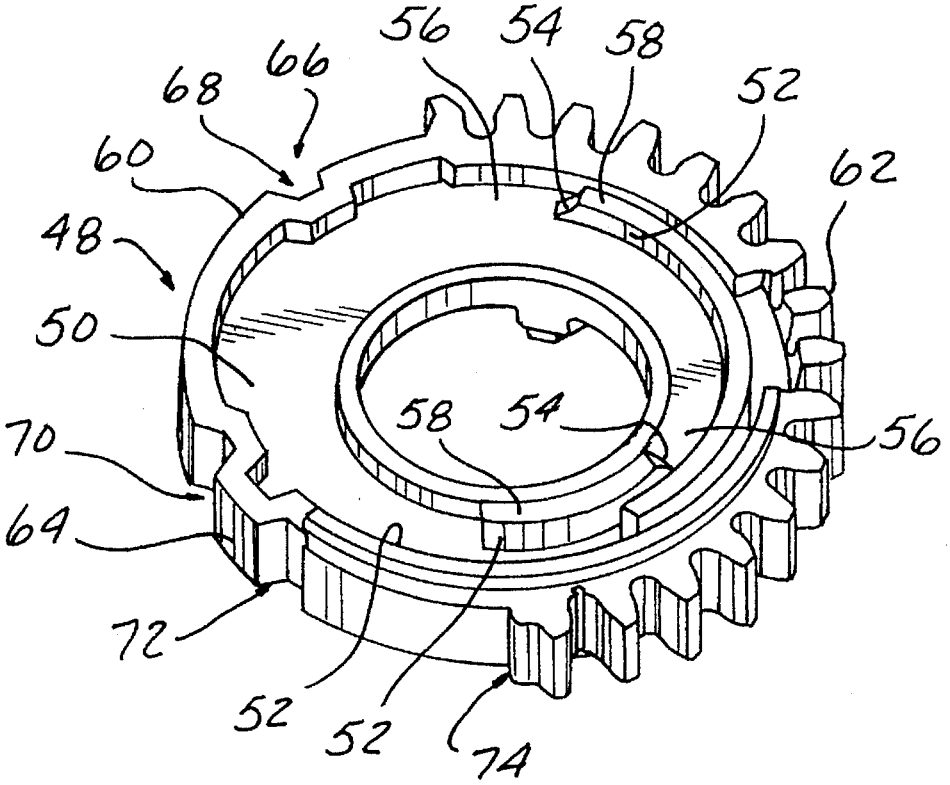
FIG. 10 is a perspective view of the opposite side of the rotatable means illustrated in FIG. 9 showing low current cam surfaces according to the present invention.

As illustrated in FIGS. 1 and 3 through 5, the plunger means 40 includes a plurality of separate, individually reciprocal actuator plungers 42 individually engaged within each aperture 38 formed in the first wall 32 of the housing means 18. The first and second parts, 16 and 30 respectively, of the housing means 18 are engageable with one another to form a substantially enclosed chamber therebetween. Extending inwardly within the chamber from the first wall 32 is a pivot support 44, a wave washer 46 is disposed on the pivot support 44 between the first wall 32 and rotatable means 48. The rotatable means 48 is connected to the housing means 18 for at least limited angular rotating movement about a pivot axis extending generally normal to the first wall 32. The rotatable means 48 includes a radially extending first side wall 50 as best seen in FIGS. 8 and 10. The radially extending first side wall 50 has at least one concentric cam surface 52 extending arcuately along at least a sector of the rotatable means 48 and opposing the at least one aperture 38 in the first wall 32. Preferably, a plurality of concentric cam surfaces 52 can be provided corresponding in number to the number of apertures 38 and electrical contacts 34 and corresponding electrical contacts 22 to be individually controlled by the electrical switch 10. As best seen in FIG. 10, each concentric cam surface 52 includes a ramp portion 54 extending between a lower, or longitudinally inward surface 56 and an upper, or longitudinally outward surface 58, such that as the rotatable means 48 is rotated between angular positions, the plunger means 40 engages the corresponding inward surface 56, ramp portion 54 and outward surface 58. While the plunger means 40 is engaging the pad 28 at one end and is opposite the inward surface 56 at another end, the electrical contacts 22 and 34 are closed with respect to one another creating an energized circuit, and after passing the ramp portion 54, with one end of the plunger means 40 engaging the pad 28 and the other end engaging the outer surface 58, the electrical contacts 22 and 34 are spaced from one another in an open position to deenergize an electrical circuit. By appropriately positioning the ramp portions 54 between the inward surfaces 56 and outward surfaces 58 various electrical circuits can be individually controlled independently of one another based on the angular position of the rotatable means 48.

Figure 6:
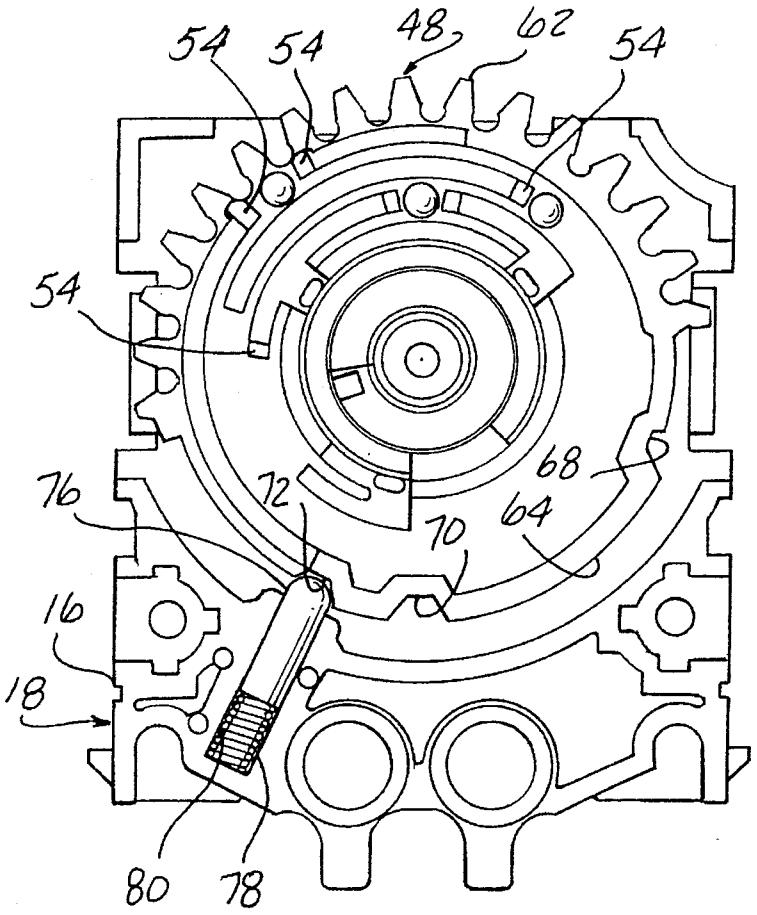
FIG. 6 is a plan view of the high current side of the ignition switch according to the present invention as illustrated in FIG. 2 with the electrically conductive leaf spring means and top half of the housing means removed for clarity.

Returning now again to FIG. 1, the rotatable means 48 preferably includes a generally cylindrical, disk-like member 60. The disk 60 preferably has a plurality of gear teeth 62 formed along at least a portion of the periphery of the disk 60 for engagement with a corresponding gear member actuated by the key lock/ignition of the motor vehicle (not shown). Of course, other methods of actuating rotation of the disk member 60 can be provided. Along the other portion of the periphery of the disk 60, a generally smooth longitudinally extending surface 64 is provided interrupted by a plurality of detents 66 for defining various angular positions of rotation for the rotatable means 48. The plurality of detents 66 correspond to an accessory detent 68, an ignition off or stop detent 70, a run detent 72 and a start portion or detent 74, best seen in FIGS. 6 and 8 through 10. The smooth longitudinally extending surface 64 and detents 66 are engaged by a radially inwardly biased projection 76. The projection 76 is preferably radially inwardly biased by a compression spring 78. The projection 76 and spring 78 can be disposed within a radially outwardly extending aperture 80 formed in the housing means 18 as best seen in FIGS. 6 and 8. A torsion spring 82 is anchored to the housing means 18 at one end through aperture 84 formed in the first wall 32 best seen in FIG. 7, while the opposite end of the torsion spring 82 engages the rotatable means 48 to bias the rotatable means in a desired rotational direction, preferably corresponding to movement of the rotatable means 48 from the start position to the run position when pressure is released from the ignition key of the motor vehicle. Locking means 86 is provided for releasably securing the housing means 18 with respect to the ignition switch casting (not shown). The locking means 86 preferably includes reciprocal locking members 88 disposed on opposite sides of the housing means 18 within respective slots 90 formed in the longitudinally extending side wall thereof. The locking members 88 are spring biased in a locking direction by compression springs 92. The reciprocal locking members 88 are engageable within slots formed within the ignition switch casting for the motor vehicle (not shown), such castings being conventional in the art.

Figure 2:
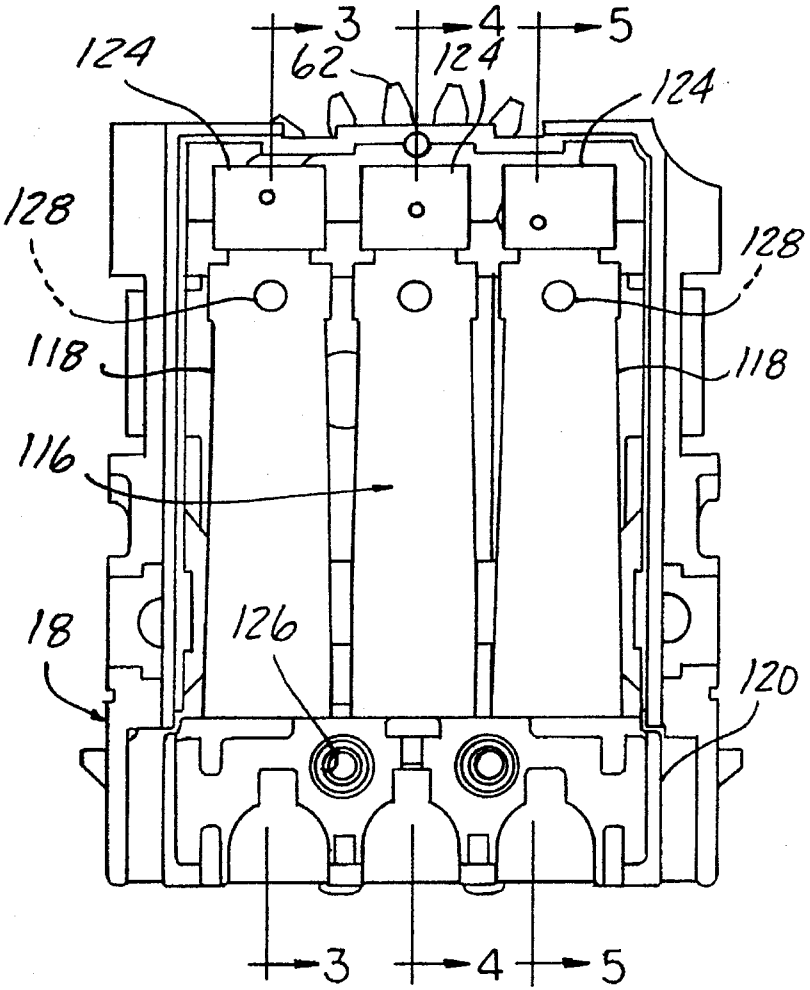
FIG. 2 is a plan view of a high current side of the ignition switch with the top cover as illustrated in the exploded view of FIG. 1 removed.

The second part 30 of the housing means 18 can best be seen in FIG. 1, FIG. 2 and FIG. 6. The second part 30 is similar to the construction to the first part 16 of the housing means 18. The second part 30 preferably includes a second wall 94 for supporting at least one electrical contact 96. Preferably, a plurality of electrical contacts 96 can be provided for individually controlling a plurality of electrical circuits. As illustrated in FIG. 1, the first part 16 is the low current side of the housing means 18, while the second part 30 is the high current side of the housing means 18. At least one electrically conductive member or plate 98 is connected to each electrical contact 96. Preferably, the electrically conductive member 98 is injection molded as an insert into the second part 30 of the housing means 18. At least one aperture 100 is formed through the second-wall 94 adjacent to each electrical contact 96 for through passage of plunger means 102. The plunger means 102 may include elongated, individual actuator plungers 104 disposed within each individual aperture 100 for longitudinal reciprocation therethrough independently of one another.

As best seen in FIGS. 3–6 and 9, the rotatable means 48 can include a radially extending second side wall 106 opposing the second wall 94 of the second part 30 of the housing means 18. Preferably, the second side wall 106 includes at least on concentric cam surface 108. Preferably, a plurality of concentric cam surfaces 108 are provided corresponding to the number of apertures 100 to the second wall 94 of the second part 30. Each cam surface 108 includes a ramp portion 110 extending between a lower, or longitudinally inward surface 112 and an upper, or longitudinally outward surface 114, such that the plunger means 102 slidably engages the second side wall 106 of the rotatable means 48 and reciprocates in longitudinal direction in response to rotation of the rotatable means 48 as it engages the inward surface 112, ramp portion 110 and outward surface 114. The opposite end of each elongated, actuator plunger 104 engages a cantilevered free end of a second electrically conductive leaf spring means 116. The plunger means 102 is similar to the plunger means 40 and is engageable through the apertures 100 in the second wall 94 for slidably engaging the cam surface 108 with a first end and for moving a second end corresponding to a contour of the cam surface 108 as the cam surface 108 moves with respect to the first end of the plunger means 102 when the rotatable means 48 is rotated between different angular positions.

Preferably, the second electrically conductive leaf spring means 116 includes at least one electrically conductive leaf spring member 118. By way of illustration, and not limitation, the present invention is disclosed with respect to three individual, independently operable leaf spring members 118 for operably energizing and deenergizing high current electrical circuits capable of handling 35 amps of continuous current with peaks up to approximately 50 amps. Preferably, each leaf spring member 118 is formed of an electrically conductive material having resilient flexibility for urging or biasing the plunger means 102 toward its respective cam surface 108. It has been found that a suitable electrically conductive metallic material for the leaf spring members 118 is beryllium copper (BeCu). Preferably, each leaf spring member 118 is insert molded with a common support 120 for fixedly securing one end of each leaf spring member 118 while leaving the opposite end of each leaf spring member 118 cantilevered for free flexing movement outwardly toward a second cover 122. Preferably, each outer cantilevered end of the leaf spring member is insert molded with an injection molded plastic pad 124 for engaging the opposite end of its respective plunger means 102. The common support 120 preferably includes apertures 126 aligned with apertures 26 through the common support 24 of the first leaf spring means 14 while passing through the first and second parts of the housing means 18 for assembling the electrical switch 10 in a final assembly with fasteners (not shown).

When connecting wires from a wiring harness to the electrical switch 10 of the present invention, it has been found that a suitable form of connection to the preferred beryllium copper material leaf spring members is ultrasonic welding of wires to a stationary side or end of the leaf springs and to the outer ends of the electrically conductive members 56 and 98. This protects the beryllium copper leaf spring from changes due to high temperature, such as the high temperatures required for soldering, which typically results in a weakened leaf spring after heating to excessively high temperatures thereby detrimentally impacting the spring back tendency desired in the electrically conductive leaf spring means 14 and 116. Of course, it should be recognized that it is not required to separate the high currency leaf spring members from the low currency leaf spring members as illustrated, and if desired, the low current leaf spring members could be interposed in any desired fashion with high currency leaf spring members, provided each electrically conductive member is appropriately sized in cross-section for the current to be handled. Further it should be understood that it is not necessary to provide both high current leaf spring members and low current leaf spring members as disclosed in the preferred embodiment, rather, if desired for a particular application, a switch according to the present invention could be configured with all high current leaf spring members or all low current leaf spring members as required. However, the switch of the present invention is particularly well adapted for use in ignition systems of automotive vehicles where it is desirable and necessary to individually control a plurality of high current and low current circuits in a single switch housing assembly.

Another unique aspect of the present invention is the ability to assemble the electrical switch 10 according to the present invention from one side, thereby building up the electrical switch in layers to simplify the assembling process. In particular, according to the present invention, the electrical switch 10 is assembled in a manner similar to that illustrated in the exploded view of FIG. 1 starting with the lower first cover 12 being positioned on a suitable fixture for assembly (not shown). The first leaf spring means 14 has the appropriate wires connected to the end terminals of the switch 10 and the appropriate terminal connectors attached to the wires. The first leaf spring means 14 is then positioned with respect to the first cover 12 and positioned thereon. The first part 16 of the housing means 18 is then positioned with respect to the first leaf spring means 14 to overlie the first leaf spring means 14 with the apertures 38 disposed opening toward the pads 28. The plunger means 40 are appropriately lubricated and inserted within-the apertures 38 having one end engaging respective pads 28 and opposite ends extending inwardly within the chamber formed by the housing means 18. The wave spring washer 46 is lubricated prior to being positioned on the pivot support 44 and the rotatable means 48 is positioned on the pivot support 44 with the wave spring washer 46 disposed between the rotatable means 48 and the first wall 42.

The projection 76 and compression spring 78 are disposed within the radially outwardly extending aperture 80 to slidably engage the relatively smooth longitudinally extending surface 64 and corresponding plurality of detents 66 formed therein to provide predetermined angular positions for the rotatable means 48. The locking means 86, including reciprocal locking members 88 and compression springs 92 are inserted within the slots 90 formed in the first part 16 of the housing means 18. The torsion spring 82 is then inserted within the pivot support 44 with one end of the torsion spring extending through the aperture 84 in the first wall while the opposite end of the torsion spring 82 is engaged with the rotatable means 48 and preloaded by rotation of the rotatable means 48 to a desired angular position creating a torsional preload on the rotatable means 48 for normally urging the rotatable means 48 from the previously described start position toward the run position.

The second part 30 of the housing means 18 is then positioned with respect to the first part 16 and is disposed overlying the first part 16 to define a chamber substantially enclosing the rotatable means 48 within the housing means 18. The plunger means 102 are appropriately lubricated and inserted within the apertures 100 having one end resting on the radially extending second side wall of the rotatable means 48 including the corresponding concentric cam surfaces 108. The second leaf spring means 116 is then positioned with respect to the second part 30 of the housing 18 and disposed thereon with the corresponding pads 124 disposed on each outer cantilevered end of the individual leaf spring ends 118 disposed for engagement with the plunger means 102 and resiliently flexible in response to longitudinal reciprocation of the plunger means 102 as the plunger means 102 are driven reciprocally through the corresponding apertures 100 as the plunger means 102 slidably engage the corresponding cam surfaces 108 in response to rotation of the rotatable means 48. A second cover 122 is positioned over the second leaf spring means 116 and the entire assembly is secured with respect to one another (not shown) extending through the apertures 126 and 26 in the common supports 24 and 120 of the first and second leaf spring means, 114 and 116 respectively, and the fasteners also passing through corresponding apertures formed in the first and second parts, 16 and 30 of the housing means 18. As the rotatable means 48 is rotated about the pivot support 44 to the various predefined angular positions defined by the plurality of detents 66, the predefined cam surfaces 52 and 108 formed on the radially extending first and second side walls 50 and 106 independently and selectively actuate the individual low current and high current leaf spring members 20 and 118 to operably energize and deenergize the desired electrical circuits when in various predefined angular positions.

While the invention has been described in connection with what is presently considered to be the most practical and preferred embodiment, it is to be understood that the invention is not to be limited to the disclosed embodiments but, on the contrary is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An electrical switch for selectively controlling an ignition circuit of a motor vehicle comprising:

housing means having a first wall for supporting at least one electrical contact and at least one aperture extending through said first wall;

rotatable means connected to said housing means for at least limited angular rotating movement about a pivot axis extending generally normal to said first wall, said rotatable means including a radially extending wall opposing said first wall of said housing, said radially extending wall having at least one concentric cam surface extending arcuately along at least a sector of said rotatable means and opposing said at least one aperture in said first wall;

free floating, plunger means engageable through said at least one aperture in said first wall for slidably engaging said at least one cam surface with a first end and for moving a second end corresponding to a contour of said at least one cam surface as said cam surface moves with respect to said first end when said rotatable means is rotated between angular positions; and electrically conductive, insert molded, leaf spring means connected to said housing means for biasing said plunger means toward said at least one cam surface and for selectively opening and closing an electrical circuit by allowing selective electrical engagement of the leaf spring means with said at least one contact in response to rotational movement of said rotatable means, said leaf spring means defining at least one high current switch operable between an open position and a closed position, and at least one low current switch operable between an open position and a closed position, both high and low current switches responsive independently of one another to movement of said plunger means as said rotatable means is rotated about said pivot axis.

2. The electrical switch of claim 1 further comprising:

said housing means including a first housing member and a second housing member, said first housing member having at least one electrical conductor in communication with said first contact supported on said first wall.

3. The electrical switch of claim 2 further comprising:

said second housing member having a second wall for supporting a second electrical contact and a second aperture extending through said second wall, said second housing member having at least one electrical conductor in communication with said second contact supported on said second wall.

4. The electrical switch of claim 3 further comprising:

said first and second housing members defining a chamber between said first and second walls substantially enclosing said rotatable means.

5. The electrical switch of claim 1 further comprising:

said rotatable means including a generally circular disk having a plurality of gear teeth formed along at least a portion of a periphery of said disk, said disk having first and second spaced, radially extending side walls.

6. The electrical switch of claim 1 further comprising:

said rotatable means moveable between at least four positions including a run position, a start position, a stop position and an accessory position.

7. The electrical switch of claim 1 further comprising:

said rotatable means including a generally smooth longitudinally extending peripheral portion having a plurality of radially inwardly extending detents formed therein; and spring biased projection means for engaging within said detents to define predetermined angular positions for said rotatable means.

8. The electrical switch of claim 1 further comprising:

said plunger means including at least one elongated plunger for actuating said leaf spring means between said closed and open positions, one end of said plunger engageable with said cam surface on said rotatable means and an opposite end of said plunger engageable with said leaf spring means.

9. The electrical switch of claim 1 further comprising:

said leaf spring means including at least one low current leaf spring member and at least one high current leaf spring member for selectively and independently electrically connecting at least one high current circuit and at least one low current circuit in response to an angular position of said rotatable means.

10. The electrical switch of claim 1 further comprising:

locking means for reciprocally sliding along opposite sides of said housing means and biased in a locking direction for releasably engaging with supporting structure of said motor vehicle to hold said housing means stationary with respect to said supporting structure of said vehicle in operative engagement with said ignition circuit.

11. The electrical switch of claim 1 further comprising:

rotary biasing means for biasing said rotatable means in an angular direction about said pivot axis.

12. The electrical switch of claim 1 further comprising:

means for assembling said electrical switch including the steps of:

supporting at least one electrical contact from housing means having a first wall and at least one aperture extending through said first wall;

connecting rotatable means to said housing means for at least limited angular rotating movement about a pivot axis extending generally normal to said first wall, said rotatable means including a radially extending wall opposing said first wall of said housing, said radially extending wall having at least one concentric cam surface extending arcuately along at least a sector of said rotatable means and opposing said at least one aperture in said first wall;

slidably engaging, free floating, plunger means within said at least one aperture in said first wall with a first end extending toward said at least one cam surface and a second end of said plunger means moveable corresponding to a contour of said at least one cam surface as said cam surface moves with respect to said first end when said rotatable means is rotated between angular positions; and biasing said plunger means toward said at least one cam surface with electrically conductive, insert molded, leaf spring means connected to said housing means, and selectively opening and closing an electrical circuit by allowing selective electrical engagement of the leaf spring means with said at least one contact in response to rotational movement of said rotatable means, said leaf spring means defining at least one high current switch operable between an open position and a closed position, and at least one low current switch operable between an open position and a closed position, both high and low current switches responsive independently of one another to movement of said plunger means as said rotatable means is rotated about said pivot axis.

13. The electrical switch of claim 1 assembled by a method comprising the steps of:

supporting at least one electrical contact from housing means having a first wall and at least one aperture extending through said first wall;

connecting rotatable means to said housing means for at least limited angular rotating movement about a pivot axis extending generally normal to said first wall, said rotatable means including a radially extending wall opposing said first wall of said housing, said radially extending wall having at least one concentric cam surface extending arcuately along at least a sector of said rotatable means and opposing said at least one aperture in said first wall;

slidably engaging plunger means within said at least one aperture in said first wall with a first end extending toward said at least one cam surface and a second end of said plunger means moveable corresponding to a contour of said at least one cam surface as said cam surface moves with respect to said first end when said rotatable means is rotated between angular positions; and biasing said plunger means toward said at least one cam surface with electrically conductive leaf spring means connected to said housing means, and selectively opening and closing an electrical circuit by allowing selective electrical engagement of the leaf spring means with said at least one contact in response to rotational movement of said rotatable means.

14. The electrical switch of claim 1 further comprising:

said housing means having said first wall for supporting at least one low current electrical contact, a second wall for supporting at least one high current electrical contact and at least one aperture extending though each of said first and second walls; and rotary means having at least one concentric cam surface extending arcuately along at least a sector of opposite radially extending first and second walls of said rotatable means, wherein each of said cam surfaces opposes at least one corresponding aperture formed in said respective first and second walls of said housing means.

15. An electrical switch for selectively controlling an ignition circuit of a motor vehicle comprising:

a housing having first and second parts, each part having a plurality of electrically conductive contacts, said housing including a plurality of apertures, one of said apertures adjacent each of said contacts, said first part of said housing having a high current conductor connected to each of said contacts supported thereon, and said second part having a low current conductor connected to each of said contacts supported thereon;

a plurality of elongated, electrically conductive, high current leaf spring members, each high current leaf spring member fixedly connected at one end to said first part of said housing and freely moveable at an opposite end, said opposite end including an electrically conductive contact extending outwardly normal to said high current leaf spring member, each of said contacts moveable with said respective high current leaf spring member independently of one another between a closed position and an open position for selectively energizing and de-energizing an electrical high current circuit;

a plurality of elongated, electrically conductive, low current leaf spring members, each low current leaf spring member fixedly connected at one end to said second part of said housing and freely moveable at an opposite end, said opposite end including an electrically conductive contact extending outwardly normal to said low current leaf spring member, each of said contacts moveable with said respective low current leaf spring member independently of one another between a closed position and an open position for selectively energizing and de-energizing an electrical low current circuit;

a rotatable member pivotally mounted between said first and second parts of said housing about a pivot axis and having a plurality of cam surfaces formed in each radially extending side face thereof and opposing respective ones of said plurality of apertures formed through said first and second parts of said housing said rotatable member moveable about said pivot axis between a plurality of angular positions; and a plurality of elongated actuator plungers, one of said plungers disposed through each one of said respective plurality of apertures in said first and second parts of said housing contacting respective ones of said high and low current leaf spring members respectively at one end and contacting respective ones of said cam surfaces on an opposite end, each of said plungers biased toward said respective radially extending side wall of said rotatable member by said respective leaf spring member, each of said plungers moveable axially in a direction parallel to said pivot axis independently of one another in response to rotation of said rotatable member for moving said contact on said respective leaf spring member between said closed and open positions.

16. A method for assembling an electrical switch for selectively controlling an ignition circuit of a motor vehicle comprising the steps of:

supporting at least one electrical contact from housing means having a first wall and at least one aperture extending through said first wall;

connecting rotatable means to said housing means for at least limited angular rotating movement about a pivot axis extending generally normal to said first wall, said rotatable means including a radially extending wall opposing said first wall of said housing, said radially extending wall having at least one concentric cam surface extending arcuately along at least a sector of said rotatable means and opposing said at least one aperture in said first wall;

slidably engaging, free floating, plunger means within said at least one aperture in said first wall with a first end extending toward said at least one cam surface and a second end of said plunger means moveable corresponding to a contour of said at least one cam surface as said cam surface moves with respect to said first end when said rotatable means is rotated between angular positions; and biasing said plunger means toward said at least one cam surface with electrically conductive, insert molded, leaf spring means connected to said housing means, and selectively opening and closing an electrical circuit by allowing selective electrical engagement of the leaf spring means with said at least one contact in response to rotational movement of said rotatable means said leaf spring means defining at least one high current switch operable between an open position and a closed position, and at least one low current switch operable between an open position and a closed position, both high and low current switches responsive independently of one another to movement of said plunger means as said rotatable means is rotated about said pivot axis.

17. The method of claim 16 further comprising the steps of:

assembling said electrical switch from one side only.

18. The method of claim 17 wherein said one sided assembling step further comprises the steps of:

positioning a first cover;

stacking said electrically conductive leaf spring means on top of said first cover;

placing said housing means on top said leaf spring means with said apertures aligned to open in opposition to free cantilevered end of said leaf spring means;

inserting said plunger means within each aperture through said housing means to engage one end of said plunger means with said free cantilevered end of said leaf spring means; and rotatably mounting said rotatable means to said housing means with said cam surface in engagement with an opposite end of said plunger means for driving said leaf spring means between flexed and non-flexed positions to open and close said electrical circuits in response to rotational movement of said rotatable means.

19. A method for assembling an electrical switch for selectively controlling an ignition circuit of a motor vehicle comprising the steps of:

supporting at least one electrical contact from housing means having a first wall and at least one aperture extending through said first wall;

connecting rotatable means to said housing means for at least limited angular rotating movement about a pivot axis extending generally normal to said first wall, said rotatable means including a radially extending wall opposing said first wall of said housing, said radially extending wall having at least one concentric cam surface extending arcuately along at least a sector of said rotatable means and opposing said at least one aperture in said first wall;

slidably engaging plunger means within said at least one aperture in said first wall with a first end extending toward said at least one cam surface and a second end of said plunger means moveable corresponding to a contour of said at least one cam surface as said cam surface moves with respect to said first end when said rotatable means is rotated between angular positions;

biasing said plunger means toward said at least one cam surface with electrically conductive leaf spring means connected to said housing means, and selectively opening and closing an electrical circuit by allowing selective electrical engagement of the leaf spring means with said at least one contact in response to rotational movement of said rotatable means;

assembling said electrical switch from one side only, wherein said one sided assembling step further comprises the steps of:

positioning a first cover;

stacking said electrically conductive leaf spring means on top of said first cover;

placing said housing means on top said leaf spring means with said apertures aligned to open in opposition to free cantilevered end of said leaf spring means;

inserting said plunger means within each aperture through said housing means to engage one end of said plunger means with said free cantilevered end of said leaf spring means;

rotatably mounting said rotatable means to said housing means with said cam surface in engagement with an opposite end of said plunger means for driving said leaf spring means between flexed and non-flexed positions to open and close said electrical circuits in response to rotational movement of said rotatable means; and inserting a spring biased projection into said housing means for engagement with a peripheral edge of said rotatable means having detents formed therein to define predetermined angular positions for said rotatable member.

20. A method for assembling an electrical switch for selectively controlling an ignition circuit of a motor vehicle comprising the steps of:

supporting at least one electrical contact from housing means having a first wall and at least one aperture extending through said first wall;

connecting rotatable means to said housing means for at least limited angular rotating movement about a pivot axis extending generally normal to said first wall, said rotatable means including a radially extending wall opposing said first wall of said housing, said radially extending wall having at least one concentric cam surface extending arcuately along at least a sector of said rotatable means and opposing said at least one aperture in said first wall;

slidably engaging plunger means within said at least one aperture in said first wall with a first end extending toward said at least one cam surface and a second end of said plunger means moveable corresponding to a contour of said at least one cam surface as said cam surface moves with respect to said first end when said rotatable means is rotated between angular positions;

biasing said plunger means toward said at least one cam surface with electrically conductive leaf spring means connected to said housing means, and selectively opening and closing an electrical circuit by allowing selective electrical engagement of the leaf spring means with said at least one contact in response to rotational movement of said rotatable means;

assembling said electrical switch from one side only, wherein said one sided assembling step further comprises the steps of:

positioning a first cover;

stacking said electrically conductive leaf spring means on top of said first cover;

placing said housing means on top said leaf spring means with said apertures aligned to open in opposition to free cantilevered end of said leaf spring means;

inserting said plunger means within each aperture through said housing means to engage one end of said plunger means with said free cantilevered end of said leaf spring means;

rotatably mounting said rotatable means to said housing means with said cam surface in engagement with an opposite end of said plunger means for driving said leaf spring means between flexed and non-flexed positions to open and close said electrical circuits in response to rotational movement of said rotatable means;

placing a second part of said housing means on top said rotatable means with at least one aperture aligned to open in opposition to said at least one cam surface of said rotatable means;

inserting additional plunger means within each aperture through said housing means to engage one end of each of said plunger means with said free cantilevered end of each of said leaf spring means;

stacking a second electrically conductive leaf spring means on top of said second part of said housing means with a free cantilevered end in engagement with opposite ends of said plunger means for moving said second leaf spring means in response to rotational movement of said rotatable means; and positioning a second cover over said second electrically conductive leaf spring means.

* * * * *